US008354942B2

(12) United States Patent
Stählin

(10) Patent No.: US 8,354,942 B2
(45) Date of Patent: Jan. 15, 2013

(54) SERVER-BASED WARNING OF HAZARDS

(75) Inventor: Ulrich Stählin, Eschbron (DE)

(73) Assignee: Continental Teves AG & Co. oHG (DE)

( * ) Notice: Subject to any disclaimer, the term of this patent is extended or adjusted under 35 U.S.C. 154(b) by 446 days.

(21) Appl. No.: 12/663,927

(22) PCT Filed: Apr. 23, 2008

(86) PCT No.: PCT/EP2008/054935

§ 371 (c)(1),
(2), (4) Date: Dec. 10, 2009

(87) PCT Pub. No.: WO2009/000572

PCT Pub. Date: Dec. 31, 2008

(65) Prior Publication Data

US 2010/0164752 A1 Jul. 1, 2010

(30) Foreign Application Priority Data

Jun. 22, 2007 (DE) ..... 10 2007 029 226
Mar. 5, 2008 (DE) ..... 10 2008 012 660

(51) Int. Cl.
*G08G 1/00* (2006.01)

(52) U.S. Cl. ..... 340/901; 340/904; 340/905; 340/988; 340/989; 340/435; 340/439; 340/472

(58) Field of Classification Search ..... 340/901–905, 340/988, 989, 435–439, 463, 472; 701/208
See application file for complete search history.

(56) References Cited

U.S. PATENT DOCUMENTS

| | | | | |
|---|---|---|---|---|
| 5,933,080 | A | 8/1999 | Nojima | |
| 6,012,012 | A | 1/2000 | Fleck et al. | |
| 6,720,920 | B2 * | 4/2004 | Breed et al. | 342/386 |
| 2002/0152115 | A1 | 10/2002 | Morita et al. | |
| 2003/0098784 | A1 * | 5/2003 | Van Bosch et al. | 340/425.5 |
| 2006/0011399 | A1 * | 1/2006 | Brockway et al. | 180/272 |
| 2007/0080829 | A1 * | 4/2007 | Biesinger et al. | 340/988 |

FOREIGN PATENT DOCUMENTS

| | | |
|---|---|---|
| DE | 195 24 949 | 2/1996 |
| DE | 196 04 084 | 10/1996 |
| DE | 197 53 686 | 6/1998 |
| DE | 197 30 791 | 1/1999 |
| DE | 101 62 406 | 7/2003 |
| DE | 102 34 595 | 2/2004 |
| EP | 0 720 137 | 7/1996 |
| EP | 12 91 824 | 3/2003 |

* cited by examiner

*Primary Examiner* — Tai T Nguyen
(74) *Attorney, Agent, or Firm* — RatnerPrestia

(57) ABSTRACT

A hazard warning unit for a vehicle for detecting hazards and for warning about hazards is disclosed, which hazard warning unit has a plurality of sensing units for sensing measured values, and an analysis unit for analyzing the measured values. If a hazard is detected, a hazard message is transferred to a central server which can then communicate said hazard message to other vehicles. The hazard information can also be buffered by the server.

14 Claims, 2 Drawing Sheets

SERVER-BASED WARNING OF HAZARDS

CROSS-REFERENCE TO RELATED APPLICATIONS

This application is the U.S. national phase application of PCT International Application No. PCT/EP2008/054935, filed Apr. 23, 2008, which claims priority to German Patent Application No. DE 10 2007 029 226.2, filed Jun. 22, 2007, and German Patent Application No. DE 10 2008 012 660.8, filed Mar. 5, 2008, the contents of such applications being incorporated herein by reference.

FIELD OF THE INVENTION

The invention relates to navigation and safety technology for vehicles. In particular, the invention relates to a hazard warning unit for a vehicle, a hazard warning system for a plurality of vehicles, the use of a hazard warning unit in a vehicle, a method for warning a plurality of vehicles about hazards, a computer program product and a computer-readable medium.

BACKGROUND OF THE INVENTION

The rapid increase in vehicle traffic on roads and the associated traffic jams and prolonging of travel times are giving rise throughout the world to increased efforts to detect traffic states and to take them into account in the selection of a route and/or in the calculation of routes in navigation systems.

Digital maps are usually already out of date when they are supplied. It is therefore absolutely necessary to update the map if the digital map is to correspond to the current conditions. However, these updates comprise a large quantity of data since the entire map always has to be updated.

When there is a hazard warning on the basis of DSRC (Dedicated Short Range Communication), a warning is given about hazards on the piece of road in front of the vehicle which have been previously discovered by another vehicle or in some other way. In this context, the hazard warnings are passed on from vehicle to vehicle or transferred to vehicles via infrastructure.

Furthermore, it is known that vehicles transmit what is referred to as floating car data (FCD). The system which is used for this is composed of a GPS (Global Positioning System) receiver and a GSM (Global System for Mobile Communication) or GPRS module. Both modules are already present in many vehicles even without FCD functionality. The GPS receiver measures the position and the FCD methods determine travel times of the vehicle from a large amount of these position data. In the GSM network, these travel times are transferred as a chain of pearls, in which individual points of the piece of road are provided with location coordinates and time stamps, to the traffic data control center. The latter can then draw conclusions about the traffic situation from these travel times. This is the way in which traffic state data are acquired for traffic information services.

SUMMARY OF THE INVENTION

An object of the invention is to disclose an improved hazard warning means for a vehicle.

A hazard warning unit for a vehicle for detecting hazards and warning about hazards, a hazard warning system, the use of a hazard warning unit in a vehicle, a method for warning a plurality of vehicles about hazards, a computer program product and a computer-readable medium are disclosed in accordance with aspects of the invention.

The described exemplary embodiments relate equally to the hazard warning unit, the hazard warning system, the use, the method, the computer program product and the computer-readable medium.

According to one exemplary embodiment of the invention, a hazard warning unit for a vehicle is disclosed which is designed for detecting hazards and for warning about hazards, and which has a sensing unit in the vehicle for sensing a measured value, an analysis unit for determining whether the sensed measured value corresponds to a hazard, and a communication unit for transferring information data about the hazard to a control center if the sensed measured value corresponds to the hazard.

In other words, the hazard warning unit is capable of detecting a plurality of different measured values and subsequently analyzing them. In this way, the hazard warning unit can determine whether a hazardous situation is present. For example, the hazard warning unit detects an intervention by the electronic stability program ESP, the corresponding speed at which the vehicle is travelling, the location at which this intervention occurs, and the current outside temperature. This plurality of measured data items are subsequently analyzed, and if, for example, a certain speed is not exceeded but, for example, at the same time a certain temperature is undershot, information data are generated which indicate, for example, ice on the road. These information data are then transferred to the control center which, if appropriate, performs further evaluation of the information data.

According to a further exemplary embodiment of the invention, the communication unit is designed to transfer the measured value by means of GPRS, UMTS or WiMax.

The use of GPRS, UMTS or WiMax makes the range of the propagation of the information significantly larger than in the case of a hazard warning by DSRC. Since a control center with a server is additionally used and there is no need for direct connection between the various vehicles, the information can also be buffered.

According to a further exemplary embodiment of the invention, additional information data about the location at which the measured value was sensed, about the time at which the measured value was sensed and about the communication unit which transmits the information to the control center are also transferred to the control center together with the information data about the hazard.

This permits the control center to assign the received data to a corresponding vehicle and also to prevent misuse by virtue of the fact that, for example, only the data of registered vehicles are taken into account.

According to a further exemplary embodiment of the invention, the communication unit is designed to receive warning data from the control center, wherein the warning data are based on the information data, received in the control center, of another communication unit.

In other words, information and warning messages are received from a plurality of vehicles in the control center. After corresponding evaluation, the warning data are also transmitted to other vehicles. In this way it is possible to obtain warning messages from other road users, with the control center being intermediately connected here in each case.

In this context, the control center manages the warning data, filters the warning data, sorts the warning data and can send quite specific, selected warning data to selected vehicles.

This permits the data traffic to be reduced.

According to a further exemplary embodiment of the invention, the communication unit is designed to call the warning data from the control center at defined times.

For example, the driver can predefine to the hazard warning unit the times at which the calling is to take place. Furthermore, the driver can trigger such a data call if, for example, he wishes to update his digital map.

According to a further exemplary embodiment of the invention, the hazard warning unit also has an encryption unit for encrypting the information data so that a uniquely defined assignment of the encrypted information data to the hazard warning unit is possible.

In this way, the probability of misuse can be reduced.

According to a further exemplary embodiment of the invention, the sensing unit has a GPS sensor, a surroundings sensor, an ESP sensor, a camera, an ABS (Anti-lock Brake System) sensor, a traction control system sensor and/or a speed sensor.

For example, a temperature sensor may also be provided.

Precise and very detailed warning messages can be generated from the plurality of measured data items.

According to a further exemplary embodiment of the invention, the control center is a traffic data control center as a service provider.

According to a further exemplary embodiment of the invention, a hazard warning system for warning about hazards for a plurality of vehicles is disclosed, which hazard warning system has a hazard warning unit described above and a control center for receiving information data from the hazard warning unit and for transferring warning data to the hazard warning unit, wherein the control center is also designed to produce the warning data on the basis of the measured values.

According to a further exemplary embodiment of the invention, the control center is designed to transfer first warning data to a first hazard warning unit of a first vehicle, and to transfer second warning data to a second hazard warning unit of a second vehicle, wherein the first warning data are different from the second warning data.

In other words, the control center is designed to individually transfer individualized warning data to the plurality of vehicles. The control center can transfer to each vehicle quite specific, selected warning data which are tailored to the vehicle. For example, the warning data can differ from vehicle to vehicle depending on the location at which the corresponding vehicle is situated. For example, a first vehicle therefore requires only warning data relating to a first part of its digital map, while a second vehicle requires warning data relating to a quite different second part of its digital map because the second vehicle is situated at a different location.

This can reduce the data traffic further.

According to a further exemplary embodiment of the invention, the control center is designed to receive information data from a plurality of hazard warning units of different vehicles and to generate warning data on the basis of all the received measured values.

Furthermore, the control center can also receive additional information, for example measured data, from sensors outside the vehicles. These are, for example, induction loops in a road or detectors at the edge of a road or, for example, under a bridge.

The received data can then be statistically evaluated in the control center. During this statistical evaluation, it is also possible, for example, to use data mining methods, that is to say statistical mathematical methods for detecting patterns.

In this way it is possible to average or filter out individual incorrect measurements, which can increase the informative power of the warning data.

According to a further exemplary embodiment of the invention, the use of a hazard warning unit described above in a vehicle is disclosed.

The vehicle is, for example, a motor vehicle such as a car, bus or truck, or else also a rail vehicle, a ship, an aircraft such as a helicopter or aeroplane or, for example, a cycle.

The warning data which are transferred from the control center to a vehicle can be used to update a digital map such as, for example, a digital navigation map. The general term "digital map" can also be understood to refer to maps for advanced driver assistance systems (ADAS) without navigation taking place in this context.

According to a further exemplary embodiment of the invention, a method for warning a plurality of vehicles about hazards is disclosed in which a measured value is sensed by a sensing unit in a first vehicle. It is subsequently determined whether the sensed measured value corresponds to a hazard. If the sensed measured value corresponds to the hazard, information data about the hazard are transferred to a control center.

According to a further exemplary embodiment of the invention, storage of the type of hazard, of the location at which the measured value was sensed, of the time at which the measured value was sensed and of an identification of the communication unit which has transferred the information to the control center also takes place in the control center. Furthermore, warning data are generated on the basis of the stored data within the control center.

According to a further exemplary embodiment of the invention, calling of warning data which are relevant for a specific, second vehicle is carried out from the control center by the second vehicle.

According to a further exemplary embodiment of the invention, a computer program product is disclosed which, if it is run on a processor, induces the processor to carry out the method steps specified above.

According to a further exemplary embodiment of the invention, a computer-readable medium is disclosed on which a computer program product is stored which, if it is run on a processor, induces the processor to carry out the method steps specified above.

A basic idea of the invention is that automatic identification of a hazard which has been detected using a vehicle sensor system takes place within the vehicle and subsequently a corresponding hazard message is transferred to a control center. The control center evaluates all the received messages and communicates to each participating vehicle the hazards which are relevant to this vehicle.

BRIEF DESCRIPTION OF THE DRAWINGS

Preferred exemplary embodiments of the invention will be described below with reference to the figures.

The illustrations in the figures are schematic and not to scale.

DETAILED DESCRIPTION OF THE PREFERRED EMBODIMENTS

In the following description of the figures, the same reference symbols have been used for the same or similar elements.

Figure 1:
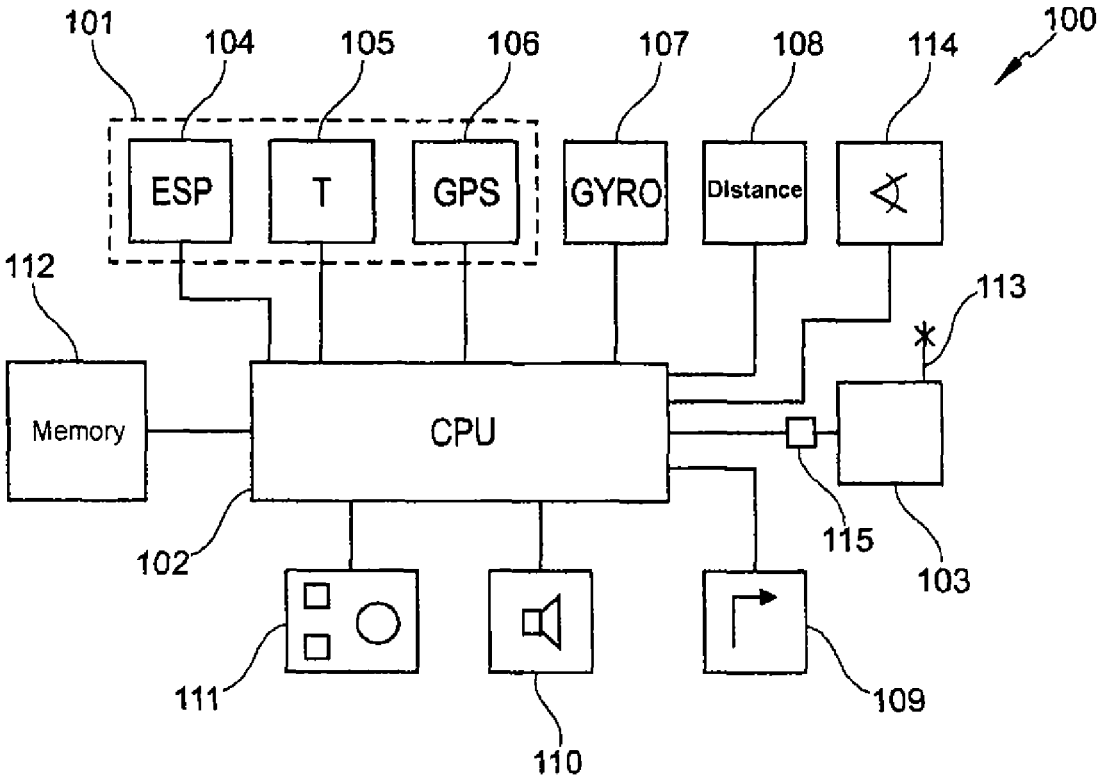
FIG. 1 shows a schematic illustration of a hazard warning unit according to an exemplary embodiment of the invention.

FIG. 1 shows a schematic illustration of components of a hazard warning unit 100 which is installed, for example, in a vehicle and which is used to detect hazards and to warn about hazards. The hazard warning unit 100 has a sensing unit 101, an analysis unit 102 and a communication unit 103.

The sensing unit 101 comprises a plurality of different sensors such as, for example, an ESP system 104, a temperature sensor 105 and a GPS unit 106 (also referred to below as a positioning unit).

The analysis unit 102 receives the measured values from the sensing unit 101 and can carry out an analysis of these measured values to determine whether the measured values indicate an actual hazard.

The communication unit 103 has an antenna 113 via which wireless communication with a server (see reference symbol 203 in FIG. 2) can take place.

An input unit 111 is connected to the analysis unit 102, which is also used as a controller of the systems connected thereto. Various settings of the hazard warning unit can be made by means of the input unit 111 and, for example, a destination and, if appropriate, also a location can be selected for a navigation unit. The inputting of the destination is possible here, for example, by inputting the entire name of the destination or else by selecting from a list which is represented on a visual output unit such as, for example, a monitor 109. The routing information is also output on the monitor 109. Furthermore, warning messages from the control center can also be output on the monitor.

These messages can also be output via the acoustic output unit 110. The outputting via the acoustic output unit 110 has the advantage that the driver is distracted less from the current events on the road. The digital map data are stored in the form of data records in a memory element 112, which is connected to the controller 102 or integrated therein. For example, additional information about traffic restrictions and the like is also stored in the memory element 112 and assigned to the data records.

In order to determine the current position of the vehicle, the hazard warning unit 100 has a navigation unit and a GPS receiver 106 which is configured to receive navigation signals from GPS satellites. Of course, the positioning unit 106 can also be designed for other satellite navigation systems.

However, since the GPS signals cannot always be received, for example in city center areas, the unit 100 for carrying out compound navigation also has a direction sensor 107, a distance sensor 108 and, if appropriate, also a steering wheel angle sensor 114. Signals of the GPS receiver, of the distance sensor, of the direction sensor and/or of the steering wheel angle sensor are processed, for example, in the control unit or sensing unit 102. The vehicle positions which are determined from these signals are reconciled with the road maps by means of map matching. The routing information which is acquired in this way is finally output via the monitor 109.

Figure 2:
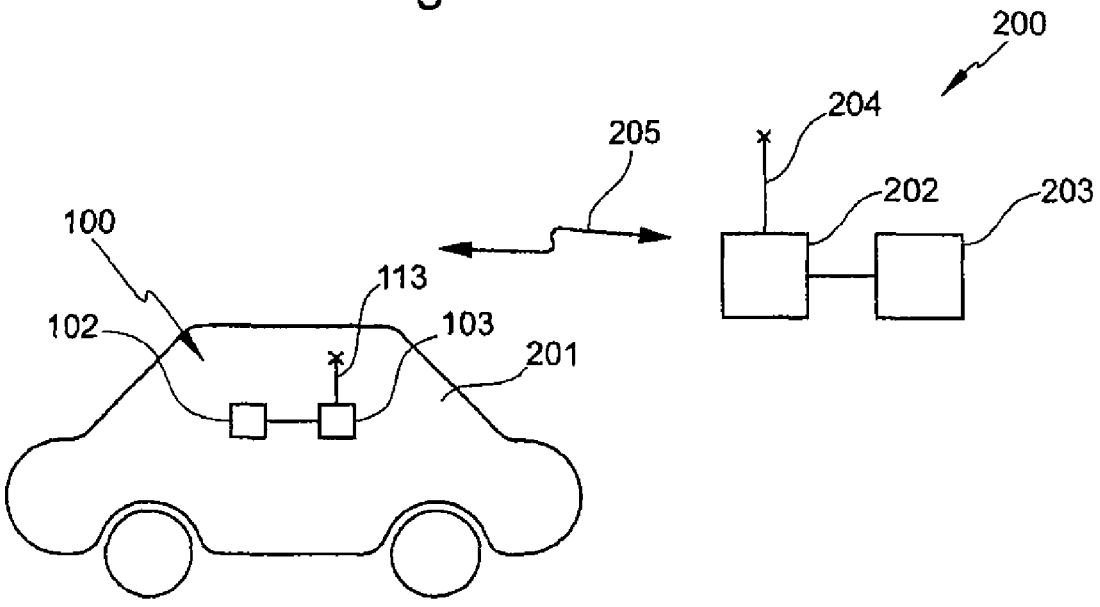
FIG. 2 shows a schematic illustration of a hazard warning system according to an exemplary embodiment of the invention.

Furthermore, an encryption unit 115 is provided which encrypts the data which are intended for transmission to the control center 200 via the communication unit 103 (see FIG. 2).

If a hazard is detected (for example, ice on the road, a stationary vehicle, or a previous accident), this information is transmitted into a database of the system 200 by means of GPRS, UMTS, WiMax or some other transmission technology. In addition to the information about the type of hazard, the location (GPS position), the detection time and who has written the hazard into the database are also stored. Other vehicles have access to the database via GPRS, UMTS, WiMax, etc. and are always provided with the information which is respectively relevant for their area. All the hazards within a certain distance of the vehicle are considered to be relevant. There is also the possibility of requesting or calling all the information if said information is necessary for calculating a route.

The transmitted data are protected by means of cryptography techniques (encrypted) and can be assigned precisely to a transmitter. This ensures that no incorrect information gets into the database from third parties.

In order to keep the necessary bandwidth to the server and back as small as possible, information is sent only if a hazard has also actually been detected. Information from the server is interrogated only at defined time intervals. These time intervals can be relatively large since as a result of the large range a large amount of time also remains until the vehicle approaches the hazard. In addition, it is appropriate to set up a push service which sends hazards from the server to the vehicle if said hazards are highly significant or have effects over a wide area.

Instead of a server, it is also possible to provide a service provider which offers the function in combination with other functions (for example Floating Car Data).

FIG. 2 shows a schematic illustration of a hazard warning system with a hazard warning unit 100 and a control center 200.

The hazard warning unit 100 is installed in a vehicle 201. The plurality of sensors are not illustrated.

The control center 200 also comprises a communication unit 202 with a corresponding antenna 204 which is connected to the server 203.

The control center 200 and the hazard warning unit 100 communicate in a wireless fashion with one another over the radio transmission link 205.

Figure 3:
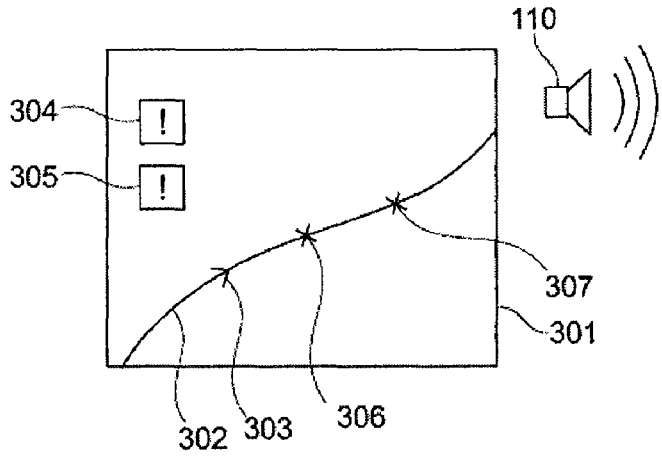
FIG. 3 shows a schematic illustration of a detail of a digital navigation map and an acoustic warning unit according to an exemplary embodiment of the invention.

FIG. 3 shows a detail 301 from a digital navigation map. A road 302 is shown on which the vehicle 303 is moving in an east/north east direction. Furthermore, two hazard warnings 304 and 305, which correspond to the measurement locations 306, 307, are included in the display. These hazards have been detected by other vehicles and transferred to the control center, after which the control center has transferred the warning messages to the hazard warning unit of the vehicle 303. This transfer took place because the vehicle 303 is moving toward the two hazardous locations 306, 307. Since the driver is already located relatively near to the hazardous location 306, an acoustic warning 110 is additionally provided in order to alert him to the hazard.

Figure 4:
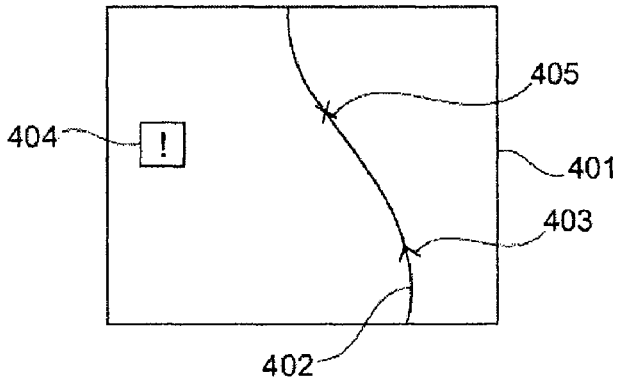
FIG. 4 shows a detail of a digital navigation map for another vehicle according to an exemplary embodiment of the invention.

FIG. 4 shows a detail 401 from another digital navigation map of a second vehicle. The map detail 401 shows a road 402 on which the vehicle 403 is located. A hazardous location 405 is shown with a corresponding warning message 404. These data have been transferred to the second vehicle because the second vehicle 403 is moving toward the hazardous location 405. The warning data in FIG. 3 have not been transferred to the second vehicle in order to keep the data traffic as low as possible.

Figure 5:
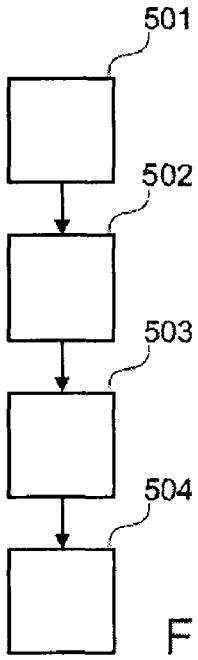
FIG. 5 shows a flowchart of a method according to an exemplary embodiment of the invention.

FIG. 5 shows a flowchart of a method according to an exemplary embodiment of the invention. In step 501, measured values are sensed in a vehicle and subsequent analysis of the measured values is carried out in order to determine whether the measured values correspond to a hazard. Subsequently, in step 502, the hazard is transferred by means of GPRS, UMTS, etc. to a server which subsequently stores the type of hazard, the position of the vehicle, the detection time and specific transmitter information. The transfer of data takes place using a cryptography technique.

In step 503, the control center subsequently generates warning data on the basis of the transferred information. In step 504, the warning data are called from the control center by a further, specific vehicle.

The information or warning data can be downloaded from the server by the vehicle by means of GPRS, UMTS or WiMax if this information is relevant to the vehicle.

A criterion for the relevance is, for example, the distance of the vehicle from the location of the hazard.

Furthermore, all the information can be downloaded from the server to the vehicle if these data are necessary for calculating a route.

The data can also be downloaded at defined time intervals or what is referred to as a push service can be used in order to warning about hazards with wide effects.

In addition, it is to be noted that "comprising" and "having" do not preclude any other elements or steps and "a" does not preclude a plurality. In addition, it is to be noted that features or steps which have been described with reference to one of the above exemplary embodiments can also be used in combination with other features or steps of other exemplary embodiments described above.

The invention claimed is:

1. A hazard warning unit for a vehicle for detecting hazards and for warning about hazards, comprising:
- a sensing unit in the vehicle for sensing a measured value;
- an analysis unit for determining whether the sensed measured value corresponds to a hazard; and
- a communication unit for transferring information data about the hazard to a control center if the sensed measured value corresponds to the hazard,
- wherein additional information data determined by a processor in the vehicle, which relates to a location where the measured value was sensed and a time at which the measured value was sensed, is transferred by the communication unit to the control center together with the information data about the hazard,
- wherein the communication unit is designed to receive warning data from the control center, and
- wherein the warning data are based on information data received by the control center from another communication unit.

2. The hazard warning unit as claimed in claim 1,
- wherein the communication unit is designed to transfer the measured value by way of GPRS, UMTS or WiMax.

3. The hazard warning unit as claimed in claim 1,
- wherein the communication unit is designed to call the warning data from the control center at defined times.

4. The hazard warning unit as claimed in claim 1 further comprising an encryption unit for encrypting the information data so that a uniquely defined assignment of the encrypted information data to the hazard warning unit is possible.

5. The hazard warning unit as claimed in claim 1,
- wherein the sensing unit has at least one sensor, selected from the group consisting of a GPS sensor, surroundings sensor, ESP sensor, camera, ABS sensor, traction control system sensor, driving state sensor, wheel speed sensors, steering wheel angle sensor and speed sensor.

6. The hazard warning unit as claimed in claim 1,
- wherein the control center is a traffic data control center as a service provider.

7. The use of a hazard warning unit as claimed in claim 1 in a vehicle.

8. A hazard warning system for warning about hazards for a plurality of vehicles,
- the hazard warning system comprising:
- a hazard warning unit as claimed in claim 1;
- a control center for receiving information data from the hazard warning unit and for transferring warning data to the hazard warning unit;
- wherein the control center is also configured to produce the warning data on a basis of the measured values.

9. The hazard warning system as claimed in claim 8,
- wherein the control center is configured to transfer first warning data to a first hazard warning unit of a first vehicle, and to transfer second warning data to a second hazard warning unit of a second vehicle; and
- wherein the first warning data are different from the second warning data.

10. The hazard warning system as claimed in claim 8,
- wherein the control center is configured to receive information data from a plurality of hazard warning units of different vehicles and to generate the warning data on a basis of all the received measured values.

11. A method for warning a plurality of vehicles about a hazard, the method comprising:
- sensing of a measured value by a sensing unit in a first vehicle;
- determining whether the sensed measured value corresponds to a hazard;
- transferring information data about the hazard to a control center if the sensed measured value corresponds to the hazard;
- transferring to the control center by a communication unit together with the information data about the hazard, additional information data determined by a processor in the vehicle, the additional information relating to a location where the measured value was sensed and a time at which the measured value was sensed; and
- receiving, by the communication unit, a warning data from the control center,
- wherein the warning data are based on information data received by the control center from another communication unit.

12. The method as claimed in claim 11, further comprising:
- storing information of: (i) a type of hazard, (ii) a location at which the measured value was sensed, (iii) a time at which the measured value was sensed, and (iv) an identification of a communication unit which transferred the information to the control center, in the control center; and
- generating warning data on a basis of the stored data.

13. The method as claimed in claim 11 further comprising:
- calling of warning data which are relevant for a second specific vehicle from the control center.

14. A non-transitory computer-readable medium on which a computer program product is stored which induces a processor to carry out:

sensing of a measured value by a sensing unit in a first vehicle;

determining whether the sensed measured value corresponds to a hazard;

transferring information data about the hazard to a control center if the sensed measured value corresponds to the hazard;

transferring to the control center by a communication unit together with the information data about the hazard, additional information data determined by a processor in the vehicle, the additional information relating to a location where the measured value was sensed and a time at which the measured value was sensed; and receiving, by the communication unit, a warning data from the control center, wherein the warning data are based on information data received by the control center from another communication unit.

* * * * *